United States Patent [19]

Danieli

[11] Patent Number: 4,513,843

[45] Date of Patent: Apr. 30, 1985

[54] RAILWAY CAR RETARDER FOR SHUNTING PURPOSES

[75] Inventor: Sten H. Danieli, Göteborg, Sweden

[73] Assignee: Carlfors Bruk E Bjorlund & Co., Huskvarna, Sweden

[21] Appl. No.: 445,962

[22] Filed: Dec. 1, 1982

[51] Int. Cl.[3] ..... B61K 7/02

[52] U.S. Cl. ..... 188/62; 188/71.2; 188/71.9; 188/82.8; 188/196 V; 188/77 R

[58] Field of Search ..... 188/62, 82.1, 30, 61, 188/82.5, 82.7, 82.74, 82.9, 82.8, 82.84, 135, 188/139, 140 A, 187, 184, 185, 180, 77 W, 77 R, 188/79.5 R, 196 R, 196 C, 196 V, 32, 71.2, 71.1, 71.5, 188/72.3; 192/45.1, 45, 50; 104/26 A

[56] References Cited

U.S. PATENT DOCUMENTS

| | | | |
|---|---|---|---|
| 3,107,633 | 10/1963 | Bick | 188/62 X |
| 3,825,100 | 7/1974 | Freeman | 188/71.2 |
| 3,938,629 | 2/1976 | Marszalek et al. | 188/62 |

*Primary Examiner*—Douglas C. Butler
*Attorney, Agent, or Firm*—Holman & Stern

[57] ABSTRACT

A brake or retarder for braking rolling railway cars preferably for shunting purposes incorporates an actuating member adapted to be given a movement by a passing railway car wheel, which movement via a speed-dependent coupling is transferred to a mechanical braking device when the speed of the movement exceeds a certain pre-set value.

10 Claims, 7 Drawing Figures

RAILWAY CAR RETARDER FOR SHUNTING PURPOSES

BACKGROUND OF THE INVENTION

1. Field of the Invention

The present invention relates to a railway car retarder for shunting purposes consisting of the type of automatic retarder units mounted one after the other along a railway track, each unit being provided with an actuating member, which when contacted by wheels of passing railway cars will exert a retarding effect on the wheels provided the speed of said wheels exceeds an adjustable value pre-set for each retarder unit.

2. Description of the Prior Art

Braking units of this type are known in several structurally different embodiments. A common feature of the embodiments which in recent years have been increasingly used is that they are of a hydraulic type, by which the passing wheel via a pedal, a ramp or the like is urged to pump a hydraulic liquid in a closed circuit in the braking unit. The liquid passes through a flow-depending throttling device, which means that the work will be large at high-flow speeds and negligibly small at low-flow speeds.

Hydraulic systems with the energy absorption here concerned with require high quality material and precision manufacture whereby they will also be expensive. It is also difficult to make, e.g., inlets for shafts and piston rods so that during several years' use and in a severe working environment they will be leakproof. The demands for leakproofness and cleanness furthermore mean that inspection and adjustment of the inner components of the brake cannot be accomplished in the field but must take place in special workshops by particularly trained personnel. The hydraulic brakes furthermore produce a certain unintended braking effect even when the cars pass at such a low speed that it is desired that they are not subjected to any braking effect whatsoever.

These drawbacks, among others, make it desirable to develop a retarder unit with the same speed-dependent working characteristics as mentioned above without utilizing any hydraulic system for the energy absorption, e.g., in the form of a simple mechanical friction brake. However, development in this direction has been hampered by the fact that the brake force must be so accurately balanced that a maximum braking effect is achieved without the risk that the brake will lift a light car wheel from the track. A hydraulic pressure can be adjusted very accurately whereas friction coefficient variations at, e.g., a disc brake can give considerable variations in the braking ability due to temperature and moisture variations, material wear, etc. A well-designed hydraulic brake has consequently a long life span and mainly constant braking characteristics, as this brake will get adequate lubrication and is subjected only to a minimum of wear as the braking energy is transferred into heat due to flow losses in the liquid and not by mechanical friction. In mechanical brakes it is, on the contrary, inevitable that the friction surfaces are subjected to a certain wear which necessitates a continuous readjustment of the positions of the braking surfaces concurrently with the wear. Finally, it is rather simple to design a hydraulic brake so that the flow speed of the hydraulic liquid constitutes a representative measure of the speed of the car wheel passing the brake, and it is no problem to provide the system with a flow-depending valve, which controls the relation between the car speed and the throttling effect. In disc brakes or similar mechanical brakes, there is, on the contrary, no real relationship between speed and braking torque, but the braking torque is quite independent of the speed.

Thus it can be said that small hydraulic brakes having three essential basic properties are well known. These three properties are: (1) a built-in speed metering which controls the braking action; (2) a well-defined braking power which allows a heavy braking without exceeding the limit at which light cars are raised from the track; and (3) that the properties will remain unaltered for a long period of time, whereby surveillance and wear adjustment are seldom required.

These three basic properties are obvious and easy to obtain in hydraulic systems, but such brakes are expensive for railway marshalling purposes. Mechanical brakes would be much less expensive but they lack the natural prerequisites of having said three properties.

BRIEF SUMMARY OF THE INVENTION

The invention relates to a mechanical friction brake, which is designed in such a manner that it incorporates the above three properties.

The purpose of the invention is to provide a railway car retarder for shunting purposes of the type used as one or more units anchored along a railway track, each unit being provided with an actuating member, which when contacted by wheels of passing railway cars will exert a retarding effect on the wheels provided the speed of said wheels exceeds an adjustable value pre-set for each retarder unit. It is the intention to provide a car retarder with the basic good features of the mechanical friction brake, but which is made in such a manner that it can match the hydraulic brake in the above-mentioned important details. Such a solution has been achieved in the invention wherein the actuating member is connected to a pivotable, mainly horizontal shaft, provided with a speed-depending unidirectional clutch connected to a braking device in such a manner that the shaft is coupled to the braking device if a car passes in the intended braking direction at a speed exceeding said adjustable value, whereas coupling fails to occur if the car has a lower speed or passes in the opposite direction. The intended braking direction is the direction in which the cars will roll freely after being pushed over the hump of the marshalling yard.

BRIEF DESCRIPTION OF THE DRAWINGS

The invention will hereinafter be further described with reference to embodiments shown in the accompanying drawings wherein.

DETAILED DESCRIPTION

Figure 1:
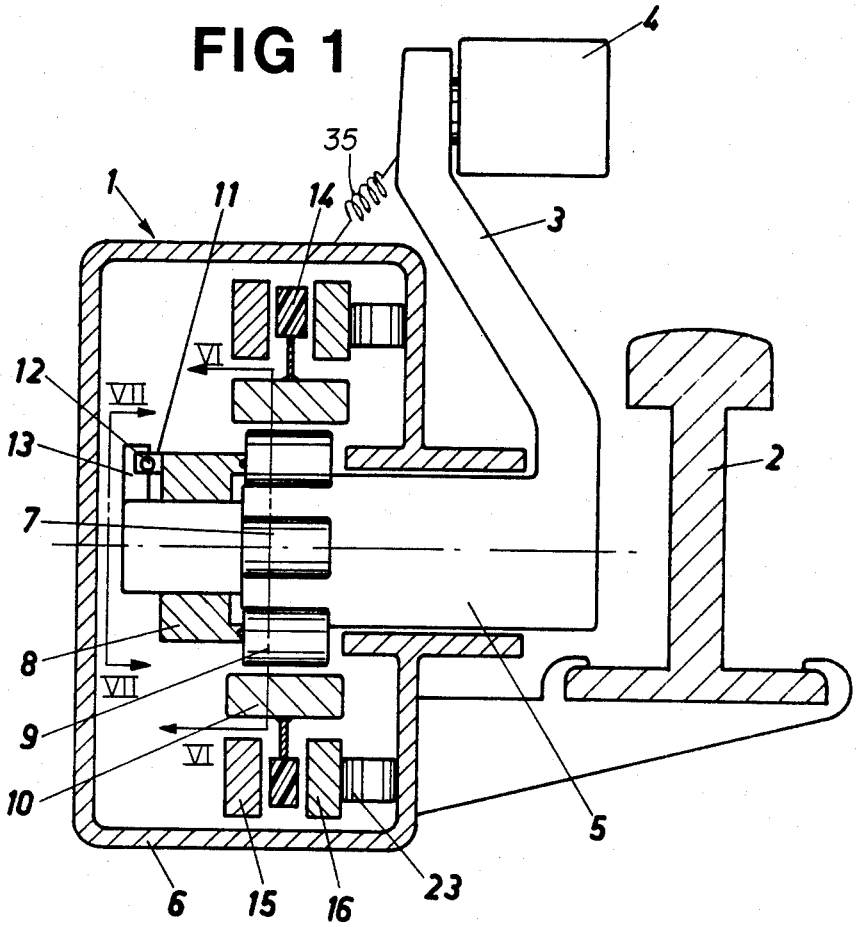
FIG. 1 is a schematic cross-sectional view of an embodiment of a railway car retarder according to the invention.

The railway car retarder 1 according to the invention is located on the inner side of railway rail 2, and incorporates an actuating member 3, in the embodiment shown shaped as a lever, which in neutral position is directed mainly upwardly and which at its upper end is provided with a pedal roller 4 arranged to be hit by a passing railway car wheel (not shown). The actuating member 3 is at its end remote from the pedal roller 4 non-pivotally connected to a mainly horizontal shaft 5, which is pivotably supported in the car retarder housing 6, and which, when the pedal roller 4 is hit by the flange of a passing car wheel, causing the lever 3 to be pushed down to a mainly horizontal position, will pivot about a quarter of a revolution. On the shaft 5 there is arranged a speed-dependent coupling, which resembles a common freewheel coupling and consists of a hub 7 having camming protrusions formed on the shaft, rollers or locking bodies 9 which are guided in slots 30 in a rolling body retainer 8 rotatably mounted on a reduced end portion of the shaft, and an outer sleeve 10 located radially outside said retainer, these parts being shaped so that the locking bodies 9 can be wedged between hub 7 and outer sleeve 10 and thereby transfer a torque between them. The rotational speed of the shaft 5 is at the beginning of its rotation directly proportional to the speed of the car wheel, and the movement starts instantaneously. It is this movement which is sensed by the speed-depending coupling and in the same manner as in a freewheel coupling this transfer of torque can take place when the shaft is pivoted in one direction only. In the device according to FIG. 1 such a connecting action is achieved when the pedal roller 4 is moved in a direction inwards into the paper.

Figure 7:
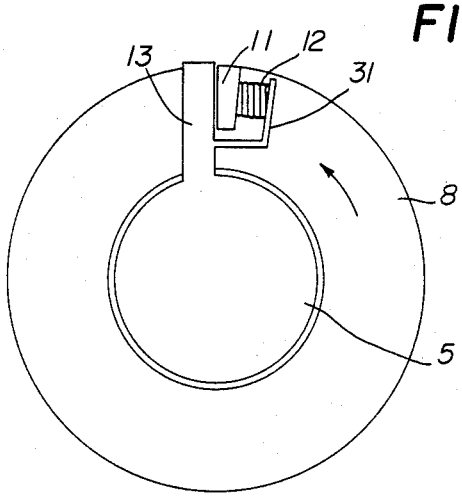
FIG. 7 is a schematic elevational view taken along line VII—VII of FIG. 1.

There is, however, an important difference between a common freewheel coupling and the coupling according to the invention in that the former has spring-loaded locking bodies, which make the torque transfer start immediately when the shaft is rotated in its working direction, whereas the coupling forming part of the car retarder is instead provided with the heavy roller retainer 8, which is readily rotatable on the reduced end portion of shaft 5. The roller retainer, as more clearly shown in FIG. 7, is maintained in a certain position of rest wherein a projection 11 thereon is pressed by means of a spring 12 against a shoulder 13 radially extending from the end of the shaft, the spring being disposed between projection 11 and a projection 31 on shoulder 13. The locking bodies 9 are in this position held by the retainer 8 in such a position relative to the hub 7 that the locking bodies cannot span the gap between hub 7 and outer sleeve 10, whereby the coupling is not engaged.

For allowing this to occur it is necessary that the roller retainer 8 be rotated a certain, small angle backwards relative to the shaft.

As mentioned earlier, the rotating of the shaft begins almost instantaneously when a car passes the retarder in the braking direction. Due to the inertia of the roller retainer 8 and the suitably chosen biasing force of the spring 12, the retainer 8 will not start to rotate immediately but will lag behind somewhat at the start, whereupon it will swiftly again take up its resting position relative to the shaft. The retainer will thus make a short movement backwards in relation to the shaft against the force of the spring, whereby the maximum angular movement is a measure of the speed of the passing car. By using a correctly chosen design and force of the spring 12 in relation to the mass of the roller retainer it is possible to achieve a maximum angular deflection at a certain car speed which corresponds to the position where the locking bodies 9 contact both hub 7 and outer sleeve 10.

Thus, the desired coupling function has been achieved, i.e., the coupling catches as a freewheel coupling only if a car passes in the braking direction and has a speed exceeding a certain level. Cars having a lower speed or cars passing in the opposite direction will not cause the coupling to engage.

The braking part is shown schematically in FIG. 1 in a simplified embodiment wherein the outer sleeve 10 is rigidly connected to a brake disc 14 provided with brake linings which can be squeezed between the two non-rotating discs 15 and 16. This constitutes the main principle for producing the braking effect when the speed-sensing coupling engages and urges the outer sleeve 10 to rotate with the shaft.

Figure 2:
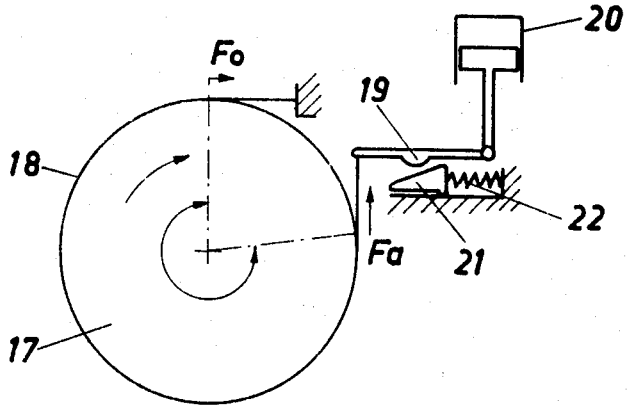
FIG. 2 is a schematic side view of the braking part of the car retarder shown in an alternative embodiment.
Figure 3:
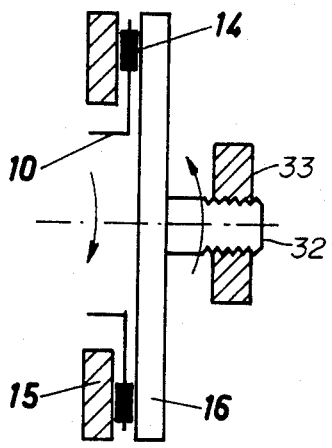
FIGS. 3 and 4 are schematic views showing different self-adjusting means for the car retarder shown in FIG. 1.

There are different ways to design the braking part so that it will function in the intended manner. FIGS. 2 and 3 show different embodiments thereof.

FIG. 2 shows a braking part in the form of a conventional strap brake, which incorporates a brake drum 17 and a brake strap 18 surrounding the drum, which strap via a lever arrangement 109 is held tightened by the power of a pneumatic cylinder 20, which acts upon the brake strap with a force Fa. The opposite end of the strap is fixedly attached and is loaded with a reaction force Fo. Due to the rotational direction of the brake disc and the dimensions given to the brake it is possible to let the braking force be substantially equal to the actuation force Fa of the pneumatic cylinder, whereby a well-defined braking power can be achieved even if the friction coefficient varies. In FIG. 2 is also schematically shown a compensating device made as a wedge 21 biased by a spring 22 so that if the power source is interrupted and wear tends to give play in the transfer, wedge 21 is automatically pressed in the forward direction. This produces an automatic wear compensation by turning off the brake.

In FIG. 3 is schematically shown the actuation principle for the braking part according to the embodiment shown in FIG. 1, and from this figure it can be seen how brake linings 14 on outer sleeve 10 are squeezed between the fixed brake disc 15 fastened to the housing by bolts or other suitable means and the adjustable brake disc 16. The actuation power from a pneumatic cylinder (not shown in the figure) or the like is allowed to act tangentially on the adjustable disc 16, which thereby is adjusted with a helical movement by screw-threaded engagement of an extension 32 thereon with a fixed member 33. The outer sleeve 10 is presupposed to rotate in the direction opposite to the direction of rotation of adjustable disc 16. If the pitch of the helical movement is small and the thread friction is negligible, balance is achieved between the actuation torque and the braking torque, as the friction torque directly counteracts the actuation torque. If the friction force exceeds the actuation torque, the disc 16 is automatically screwed axially outwardly until the squeezing force against the brake linings has been reduced so that balance is reached, and if the actuation torque is greater this will adjust the disc 16 until balance is reached.

Figure 4:
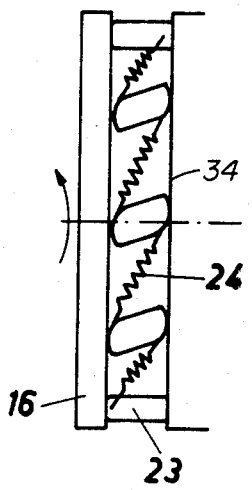

In order to eliminate the friction of the helical movement, it is possible as shown in FIG. 4 to substitute for the screw threaded members 32, 33 a number of locking bodies 23, which support the disc 16 for movement axially with respect to a fixed part 34. When the disc is rotated in the direction shown, the locking bodies will rise and press the disc axially against the brake linings (not shown). Due to the fact that the locking bodies are biased by means of springs 24, a wedge action is obtained providing an automatic wear compensation which allows the actuation movement of the power source (e.g., the pneumatic cylinder) to be very short.

Figure 5:
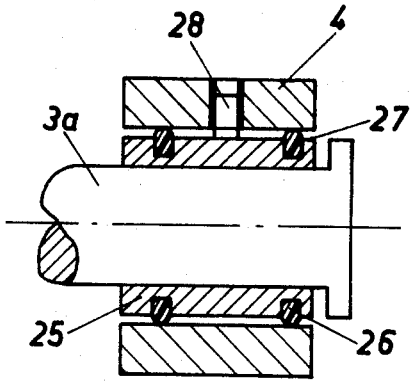
FIG. 5 is a schematic cross-sectional view of a part of an actuating member forming part of the car retarder according to the invention.
Figure 6:
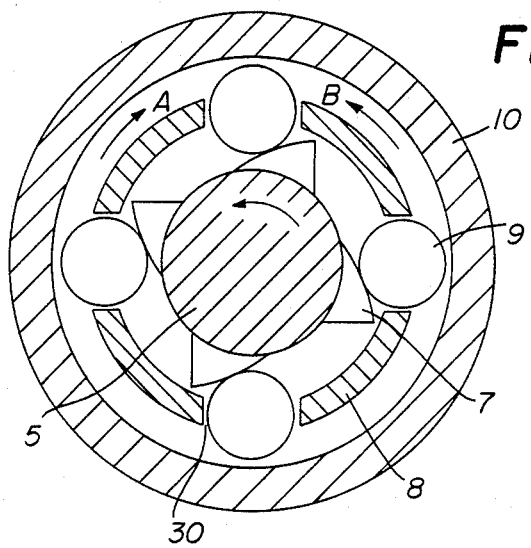
FIG. 6 is a schematic cross-sectional view taken along line VI—VI of FIG. 1.

In FIG. 5 is shown in cross section and schematically the upper part of the actuating member 3 and particularly the pedal roller 4 thereof. By means of the car retarder according to the invention the above-mentioned tendency of unintended braking occurring in hydraulic brakes is eliminated, but this can instead give rise to bounces at impact between the car wheel and pedal roller. In order to provide a solution to this problem the shaft 3*a* extending from the pedal arm of the actuating member 3 is provided with a bush 25, which at its outer envelop surface is provided with two parallel and spaced-apart annular grooves 27 in each of which is arranged an O-ring 26 of suitable size.

The pedal roller 4 is then arranged on the outside of the bush 25, and can be locked to the bush with the aid of a set screw 28 or the like. In the annular gap space formed between the two O-rings 26, the inner envelope surface of the pedal roller 4 and the outer envelope surface of the bush 25, is introduced a volume of oil filling up said space. Due to this measure, the pedal roller will have a sufficient damping effect for eliminating bounces of the above-mentioned type without the need of maintaining the unintended braking effect of the hydraulic brake.

The invention thus provides a railway car retarder, which despite its simple basic structure has properties fully comparable to those of hydraulic braking units, and at the same time has certain evident advantages compared to these older hydraulic brakes, regarding weight, cost, and possibilities of inspection and service at the place of use.

The braking action of the brake is directly dependent on an adjustment force, which can be generated by a pneumatic cylinder. By evacuating the air pressure it is possible very swiftly to cut out the braking function of the retarder in order to allow, e.g., unbraked passage of a locomotive, which is not possible with known hydraulic brakes which must therefore be folded away, resulting in a complication. The lever of the actuating member must, after it has been pressed down by a passing car, be raised again in order to be ready to perform the braking, and this can be achieved with the aid of return springs 35 or the like, but it is also possible to use a pneumatic cylinder which is supplied with pressurized air from the same source as that generating the adjusting power in order to maintain the pedal in upright position. In this case it is also an advantage that the braking pedal is folded down if the air supply to the brake is cut off.

The invention is not limited to the embodiments shown in the accompanying drawings and described in connection thereto but modifications and variations are possible within the scope of the following claims.

I claim:

1. A railway car retarder for shunting railway cars having an actuating member which when contacted by wheels of a passing railway car will retard the speed thereof when said speed exceeds a pre-determined value comprising:

a housing member adapted to be mounted adjacent a railway track;

a shaft rotatably mounted in said housing;

an actuating member connected to said shaft and adapted to be engaged by a railway car wheel on which a railway car is moving;

a mechanical friction brake operatively mounted in surrounding relationship with respect to said shaft to produce a braking force when actuated; and a speed-sensitive uni-directional clutch operatively interposed between said shaft and said brake so that said clutch will connect said shaft to said brake when the railway car is moving in the direction in which the retarding is intended to be provided by the retarder and at a speed exceeding said pre-determined value.

2. A railway car retarder as claimed in claim 1 wherein said clutch further comprises:

means for adjusting the speed sensitivity of said clutch to set the pre-determined speed at which said clutch is operated.

3. A railway car retarder as claimed in claim 2 wherein:

said means to produce an actuating force on said brake comprises pneumatic cylinder means.

4. A railway car retarder as claimed in claim 1 and further comprising:

means providing an actuating force on said brake to produce a friction force; and means to counteract said brake actuating force so that said friction force and brake actuating force balance each other.

5. A railway car retarder as claimed in claim 4 and further comprising:

adjusting means to adjust said brake so that said braking force will have the desired value irrespective of variations in the friction brake due to wear.

6. A railway car retarder as claimed in any of claims 1, 2, 4, 5 or 3 wherein:

said shaft is mounted to rotate about a substantially horizontal axis; and said actuating member comprises a lever extending substantially vertically in the initial un-actuated position to above the upper edge of a rail of the track so that it is pushed downwardly to a substantially horizontal position to produce a corresponding pivoting of said shaft.

7. A railway car retarder as claimed in claim 6, and further comprising means to return said lever to the substantially vertical initial un-actuated position upon disengagement with a railway car wheel.

8. A railway car retarder as claimed in claim 4 wherein said brake further comprises:

a first brake disc fixedly mounted coaxially around said shaft;

a non-rotatable axially adjustable second brake disc mounted on said housing coaxially with said first disc;

a rotatable third disc operatively mounted on said clutch to be rotated thereby;

a fixed base on said housing;

rolling bodies operatively interposed between said fixed base and said second disc; and resilient members urging said rolling bodies toward the position wherein they always operatively engage said fixed base and said second disc irrespective of the direction of rotation of said second disc to adjust said second disc.

9. A railway car retarder as claimed in claim 1 wherein said uni-directional clutch comprises:

locking members; and a retainer means operatively retaining said locking members in relative relationship so that said locking members are prevented from engaging into a locking position of the clutch below said pre-determined speed and allow said locking members to engage in the locking position when sufficiently large angular acceleration of said shaft produces sufficient displacement of the retainer.

10. A railway car retarder as claimed in claim 9 wherein:

said locking members comprise rolling bodies; and further comprising spring means to resiliently bias said retainer toward the non-locking position.

* * * * *